United States Patent [19]

Boyd

[11] 3,959,423

[45] May 25, 1976

[54] MODULAR CONSTRUCTION SYSTEM

[75] Inventor: James Lee Boyd, Houston, Tex.

[73] Assignee: Gerald D. Hines Interests, Houston, Tex.

[22] Filed: Sept. 26, 1974

[21] Appl. No.: 509,709

Related U.S. Application Data

[63] Continuation-in-part of Ser. No. 395,189, Sept. 7, 1973, abandoned.

[52] U.S. Cl. ..... 264/34; 52/220; 52/324; 249/18; 249/28; 249/85; 264/35; 264/261; 264/271; 264/279; 264/DIG. 57

[51] Int. Cl.[2] ..... E04B 1/16

[58] Field of Search ..... 264/35, 271, 279, 261, 264/DIG. 57, 34; 249/18, 19, 28–32, 50, 83, 85, 96, 97; 52/220, 221, 324

[56] References Cited

UNITED STATES PATENTS

| | | | |
|---|---|---|---|
| 1,681,493 | 8/1928 | Miller | 264/256 |
| 1,963,984 | 6/1934 | Garrett | 249/30 X |
| 2,194,536 | 3/1940 | White | 249/28 X |
| 3,353,220 | 11/1967 | Lenoble | 264/313 X |
| 3,744,945 | 7/1973 | Metrailer | 249/28 X |

*Primary Examiner*—Robert F. White
*Assistant Examiner*—Thomas P. Pavelko
*Attorney, Agent, or Firm*—Arnold, White & Durkee

[57] ABSTRACT

A construction system for constructing multistory buildings is disclosed. Concrete joists are poured in place, using high-strength concrete. The concrete is poured into a removable, reusable ganged-form structure. The sides of the joist forms swing away from the joists after the concrete is set. Monolithic slab soffits, comprising an underlayer of gypsum board and an overlayer of concrete are pre-cast and moved into place to connect the joists before pouring of the joist concrete. The combination of pre-cast soffits and poured-in-place joists permits rapid and inexpensive construction of the multiple floors of a building. Alternatively, the slab soffit may be poured in place, in the same pour as for the joists, by placing fire-resistant boards between adjacent joist forms, thereby eliminating the need for cleaning any form work in those areas.

6 Claims, 9 Drawing Figures

FIG. 1
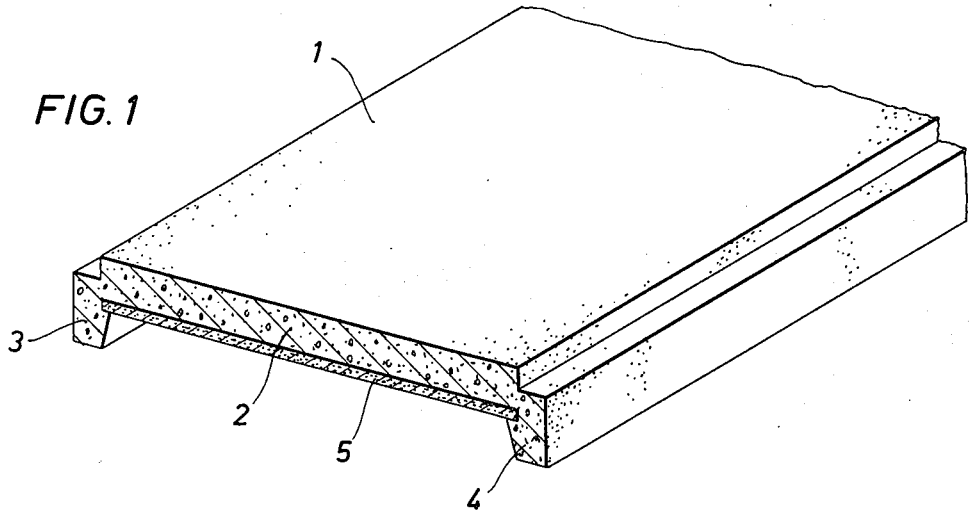
FIG. 2
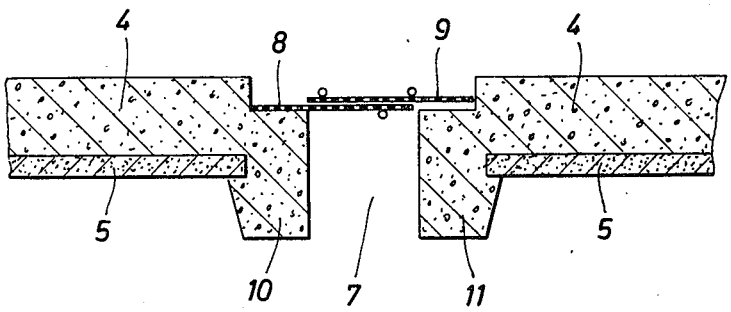
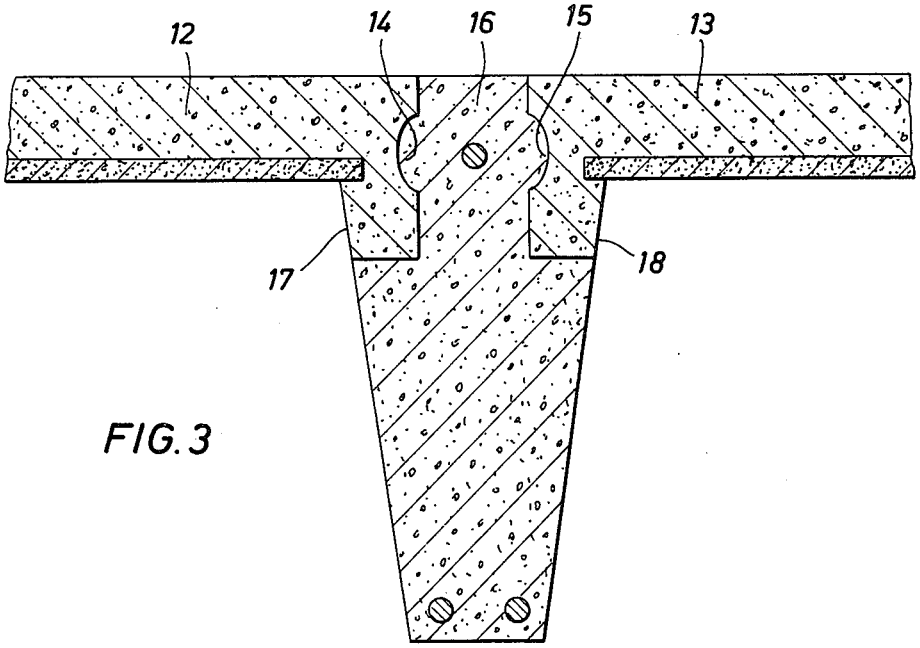
FIG. 3

FIG. 5
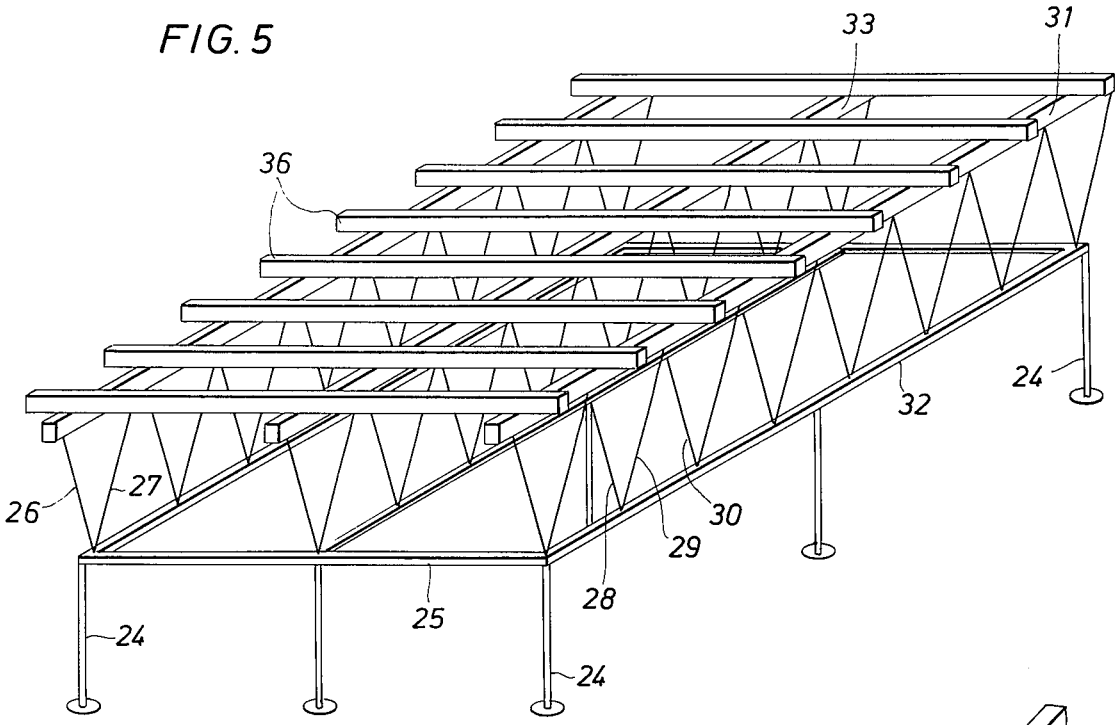
FIG. 6
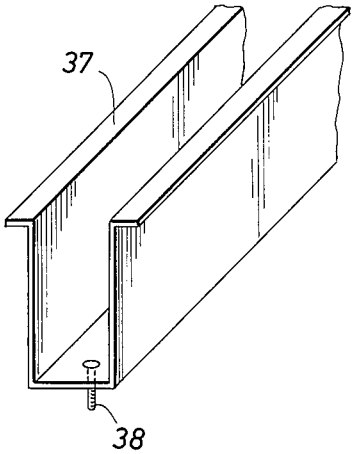
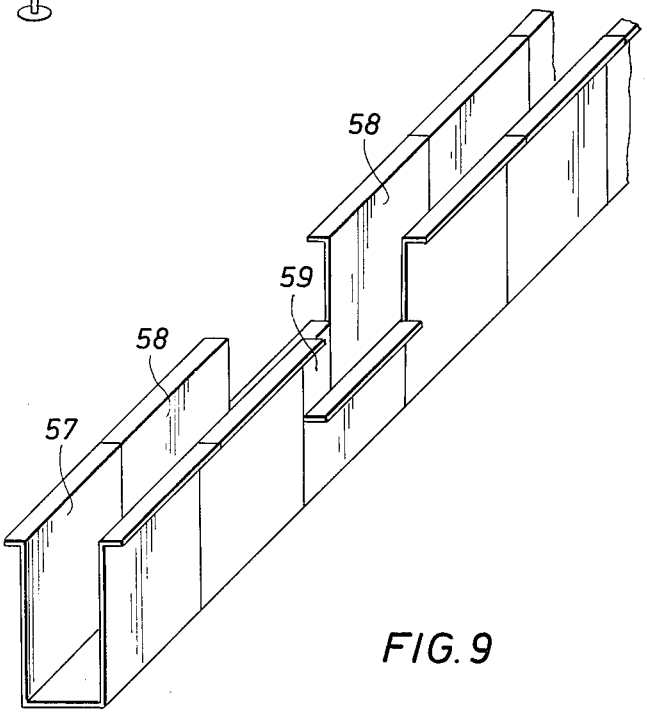
FIG. 9

MODULAR CONSTRUCTION SYSTEM

EARLIER COPENDING APPLICATION

This is a continuation-in-part of my co-pending application Ser. No. 395,189, filed Sept. 7, 1973, now abandonded, assigned to the assignee hereof.

FIELD OF THE INVENTION

This invention relates to building construction, and more particularly to multifloor concrete modular building construction.

BACKGROUND OF THE INVENTION

The critical factors in building design and construction today are time and cost. In concrete form work, for example, it has been known to employ ganged forms in a modular arrangement, in order to simplify and shorten the time for setting up for a concrete pour.

It has also been known to pre-cast various concrete elements, and then transport them and implace them in the structure. The limitations here, however, are in weight and size. Large pre-cast structures will not only be difficult to transport, they will also be subject to being damaged and causing damage in the implacing process. Further, larger and more expensive hoists will be required to put these components in place.

Accordingly, it is a feature of the present invention to provide a construction system which is quick and inexpensive to implement.

It is a further feature of the invention to provide a construction system which does not require heavy-load hoists.

It is still another feature of the invention to provide a system whereby succeeding floors can be constructed rapidly after construction of preceding floors.

Other and further features and advantages of the invention will be apparent to persons skilled in the art, from a consideration of this specification, including the claims and the drawings.

SUMMARY OF THE INVENTION

According to the present invention, concrete joists are poured in place, using high-early strength concrete. The concrete is poured into a removable, reusable ganged-form structure. The sides of the joist forms swing away from the joist after the concrete is set. Monolithic slab soffits, comprising an underlayer of gypsum board and an overlayer of concrete, are precast and moved into place to connect the joists before setting of the joist concrete. The combination of pre-cast soffits and poured-in-place joists permits rapid and inexpensive construction of the multiple floors of a building. Alternatively, poured-in-place soffits can be advantageously employed, significantly reducing the amount of form work previously required.

BRIEF DESCRIPTION OF THE DRAWINGS

FIG. 1 is a pictorial view of a soffit slab according to the present invention.

FIG. 2 is a partial end view of a pair of soffit slabs according to the present invention.

FIG. 3 is an end view of a joist, with an alternative configuration of soffit slabs.

FIG. 5 is a pictorial view of the support structure employed with the forming module of the present invention.

FIG. 6 is an end pictorial view of a joist-forming member, employed with the system of the present invention.

FIG. 9 is a pictorial view of a joist-forming member, in multiple abutting sections.

DETAILED DESCRIPTION

Figure 4:
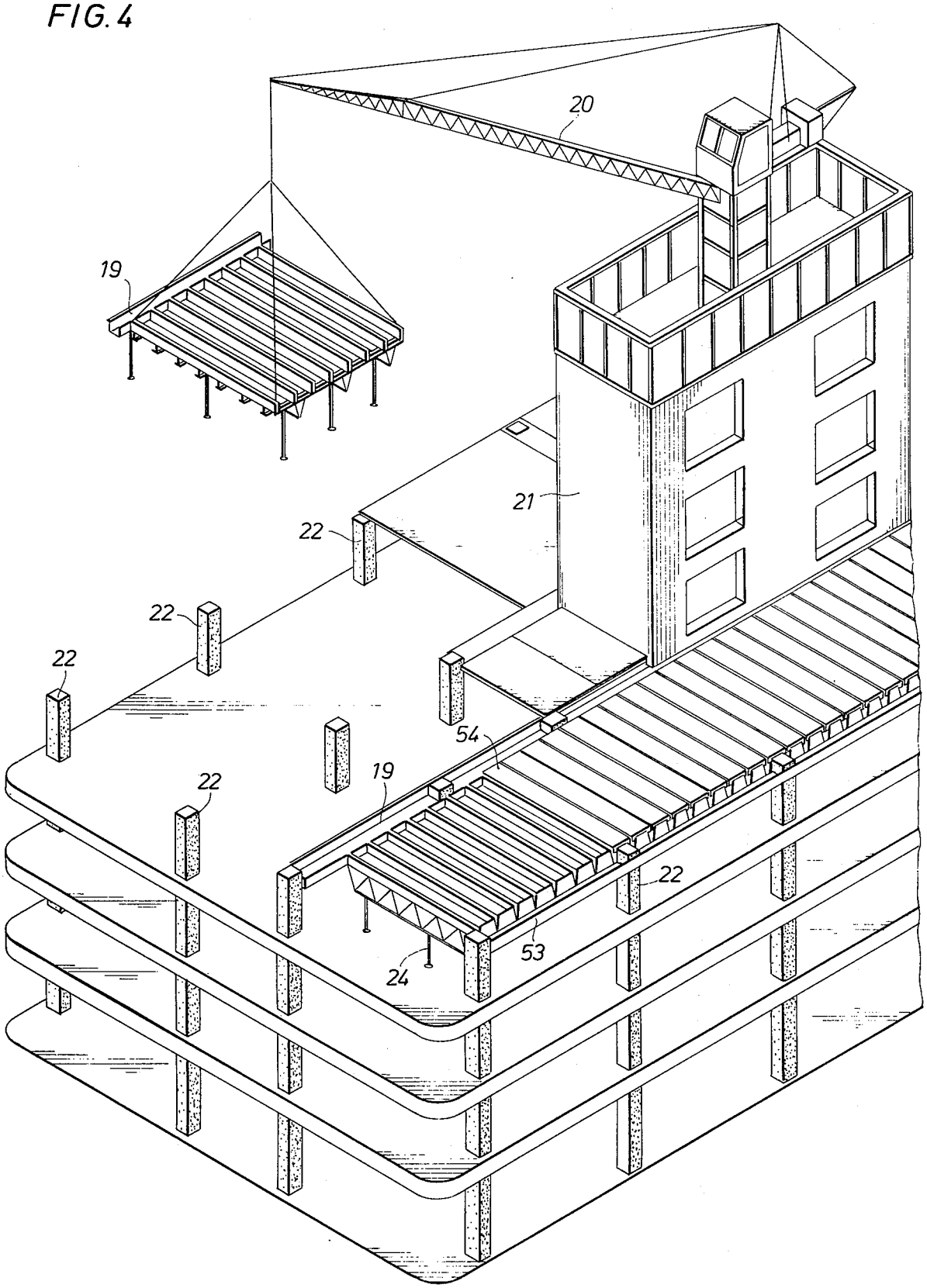
FIG. 4 is a pictorial illustration of construction of a structural slab of a building, according to the system of the present invention.

The first aspect of the construction system of the present invention is a unique slab soffit construction.

Slab soffits are used to form the structural floor of a building. These soffits may be bay-length rectangular elements, which will be set in place as later described.

One of the design requirements for a slab soffit is the fire rating. For example, one of the standard ratings for a floor system is that it be "2-hour fire rated," which as well understood by persons skilled in the art, means that the floor must be able to withstand a fire, of specified temeperature and geometry, for a period of 2 hours without failure. One way to meet such a requirement is to employ a concrete thickness in excess of 2½ inches. This technique would typically add significantly to the weight of the slab. In large buildings, this would constitute a huge addition to the weight, thus requiring additional strength in columns, steel, and foundation.

Another technique was to use a 2½ inch thickness of concrete, and to apply a fireproofing coating after installation. This coating would cost approximately 55 cents per square foot to apply, considering material and labor, and would, of course, requiree considerable time.

It may also have been known to employ a two-layer laminate of concrete and gypsum board, with the gypsum board being glued to the concrete, and further fastened with nails. This procedure involved a significantly high labor cost.

Slab soffits according to the present invention eliminate the foregoing difficulties. A pre-cast structure of gypsum board and concrete is employed.

Referring now to FIG. 1 of the drawings, a slab soffit 1 is shown, composed of a concrete portion 2, having side sections 3 and 4, and a gypsum-board layer 5. This structure may be made by forming up for the side sections 3 and 4. Gypsum board 5, having a thickness of five-eighths inch, if 2-hour fire rating is desired, is placed across the forming members for side sections 3 and 4.

The gypsum board 5 will be laid across and upon the side-forming members, such that the left and right edges of the gypsum board 5 will extend beyond the interior sides of the side-forming members. The gypsum board 5 is seen to be partially surrounded by, or embedded in, the concrete layer 2-3-4.

After placing appropriate flat formwork at the ends, i.e., in the planes parallel to that of the concrete face shown at 2-3-4 of FIG. 1, concrete is then poured to complete the soffit, such that the thickness of the span portion 2 is 2½ inches, again referring to a design for two-hour fire rating. The concrete may have a strength capability, for example, of 100 pounds per square foot, safe superimposed live load. It will be noted that the gypsum board 5 serves the function of a form, and advantageously eliminates the need for forming on the underside of the slab, or by saving the time and labor involved in cleaning such a forming surface prior to the next pour. The gypsum board layer 5 may be supported during the pour by dirt, sand, or other suitable and readily available substances. A rigid support can be used, if desired; no cleaning will be necessary, since the gypsum board layer 5 constitutes a consumable form member.

The downward projection configuration of side sections 3 and 4 of the slab soffits can be other than that shown in FIG. 1. It is, however, advantageous to have some form of downwardly projecting configuration to simplify positioning, add strength for erection purposes, and prevent lateral movement during joist pours. Downwardly projecting side sections, therefore, provide relatively easy positioning of the slab soffit 1.

As mentioned before, side sections 3 and 4 can be different configuration than shown in FIG. 1.

Referring to FIG. 2 of the drawings, two slab soffit sides sections 4 and 6, employing the configuration of FIG. 1, are shown. The space between these side sections forms a pour slot 7, through which concrete may be poured to form a joist, as will hereinafter be described. Before or during pouring of the joist, the side sections 4 and 6 of the slab soffits may be joined by conventional steel mesh members 8 and 9, or by other suitable closure means. The lip edges 10 and 11 will be placed contiguous with the top portions of joist-forming elements, as will hereinafter be described.

An alternative slab soffit side section may be formed as shown in FIG. 3. Here, side sections 12 and 13 are formed with shear-key portions 14 and 15. The pour slot 16 will accordingly have a key-shaped configuration, enhancing the load distribution properties of the floor. The faces 17 and 18 of the side sections are shown here as lying in a plane at an angle to the vertical. Such configuration would be used where the joists are to be either V-shaped as shown, or rectangular in cross-section.

Slab soffits constructed as above described are seen to have significant advantages over previously known constructions. First, there is no forming member required for the bottom surface of the slab; hence, the cleaning of that member is eliminated. Second, the gypsum board and concrete are cast together in a unitary or "monolithic" structure; hence, there is no need for fastening by gluing and nailing, both of which are time consuming and expensive. As will later be described, these slab soffits become sections of the structural slab of a building floor. By trowelling at the precasting site, the tops of the soffits will be ready, without further finishing, to receive carpet or other finished floor material.

It will be understood, of course, that slab soffits according to the present invention may be reinforced and prestressed in conventional fashion.

Leaving these pre-cast slab soffits for a moment, we turn now to the construction of joists, according to the system of the present invention. Joists are structural support members extending between spandrels and interior girders, or other heavier structural beam-like elements. The spandrels and girders typically connect, and are supported by, vertically extending columns, which are the principal means of support of the building. These columns may be laid out in square, rectangular or round configurations and connected by spandrels, interior girders or beams, which in turn are transversely connected by the joists. According to the system of the present invention, the above described slab soffits are placed over adjacent pairs of joist forms, with downward projections into the joist forms for rapid location.

The joists, girders and spandrels are formed in the following manner.

A three-dimensionally adjustable and reusable forming module is employed. Referring now to FIG. 4 of the drawings, such a module is designated generally by the numerals 19. As shown, this module is of an open grid configuration, having spaces between adjacent joist-forming members, and of such lightweight construction that it can be readily hoisted by a crane 20 mounted on the central core 21 of a building. The module 19 is lowered into place between pre-cast columns 22 as shown. The interior side of the module contains forming 23 for construction of the interior girder. Prior to pouring the girder, reinforcing connectors (not shown) will be inserted in the girder forming 23 and through openings (not shown) in or around columns 22, whereby the poured floor section will be suspended from the columns 22, in conventional fashion. In lieu of pre-cast columns 22, the columns could be poured-in-place, steel or composite.

The structure of the forming module 19 is better appreciated by referring to FIGS. 5–9 of the drawings.

Referring now to FIG. 5, a support frame, preferably made of a lightweight metal, is provided to support the form work. The support frame has a plurality of legs 24 which may be raised and lowered hydraulically or by cable hoist. From these legs extend various bracing pieces, such as shown at 26–33 of FIG. 5. Across the top of the bracing structure are placed a plurality of metal and wood stringers 36, in parallel relationship.

Referring now to FIG. 6, a typical form for a joist is shown. It is seen to have a generally rectangular cross-section, although this is not necessary. The form 37 should be made of a material sufficiently flexible to permit the sides of the form to be flexed away from the set concrete, in stripping. For example, ⅛ inch fiberglass backed with ½ inch plywood, or 16 gauge steel might be employed. A number of sections may be placed in abutting relationship, to provide adjustability of joist length. Through the bottom of each section of the joist form 37 is passed a bolt or other suitable fastener 38. This will permit attachment of the joist form 37 to the top of a stringer 36 (shown in FIG. 5), by passing the fastener through holes or slots (not shown) in the top of the stringer.

Figure 7:
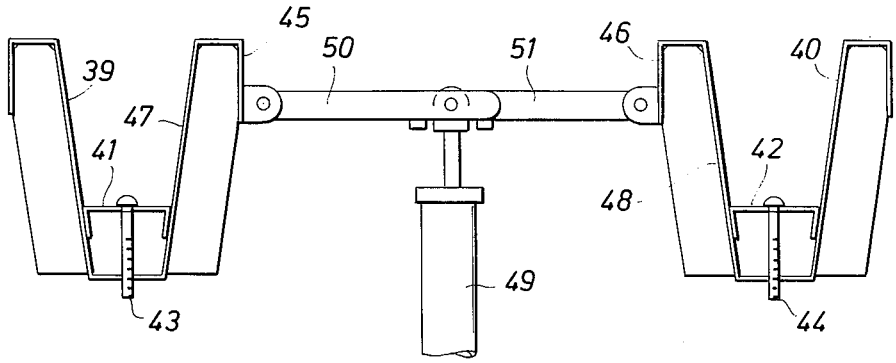
FIG. 7 is an end view of joist-forming members, with a mechanically actuated form stripper.

FIG. 7 of the drawings shows an alternative joist form design, and illustrates a technique for setting and stripping the form sides. FIG. 7 depicts an end view of a pair of adjacent joist forms 39 and 40, shown in the locked position. The bottoms of joist forms 39 and 40 are formed by insertion of separate bottom pieces 41 and 42, held in place by bolts 43 and 44 respectively. These bolts may also be used to fasten the joist form to the aluminum stringers at the top of the support structure, as previously described. Running along the entire length of the side of each joist form 39 and 40 is a whaler 45 and 46. Whalers 45 and 46 serve to connect all the sections of the joist form sides 47 and 48. At some convenient point between the joist forms 39 and 40, a mechanical actuator 49 is located. The actuator 49 might be hydraulically operated, but this is not necessary. Actuating arms 50 and 51 serve to pivotally connect the actuator 49 with the whalers 45 and 46. In operation, the actuator 49 typically is of the over-centered acting type. Thus, by a single motion of the actuator, all sections of joist forms 39 and 40 are placed either in a locked position reeady for a concrete pour, or in the stripping position.

Figure 8:
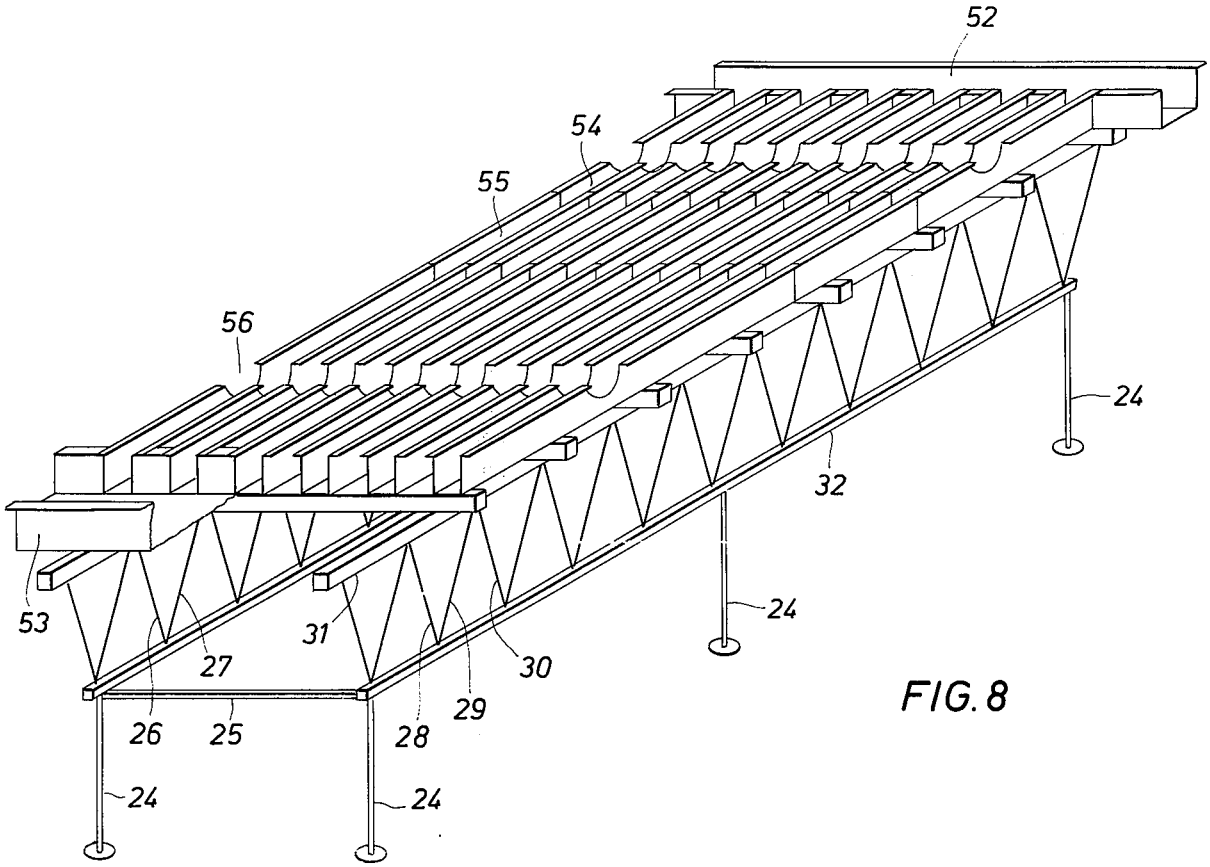
FIG. 8 is a pictorial view of a forming module employed with the system of the present invention.

FIG. 8 of the drawings illustrates an embodiment of an assembled open grid form module according to the present invention. The support frame, as discussed above with respect to FIG. 5, is seen to consist of legs 24 and bracing members such as 25–32. Aluminum stringers 36 are partially shown, being more fully shown in FIG. 5. With continuing reference to FIG. 8, the forming piece for the interior girder is shown at 52. At the opposite end of the module, the form for the spandrel is shown at 53. Typical side forms for the joists are shown at 54, with a removable section 55. The joist forms may have holes or cutaway portions 56. These permit laying of pipe, air conditioning ducts and the like, in place before the joists are poured. This procedure saves significantly on overall height of the building, since the present practice is to hang these pipes and ducts from the joists after casting. Such procedure adds, typically, 8–10 inches to each story of the building. It is readily seen that a 30-story building can be made 20 ft. or more lower in overall height by the construction system of the present invention, without losing usable volume within the finished building.

As an alternative to the cut-out portions 56 in FIG. 8, provision for casting in ducts, pipes, etc., can be made as shown in FIG. 9 of the drawings. Here, a plurality of abutting joist form sections 57, 58, 59 and 60 are employed. The height of section 59 is reduced to accommodate, for example, an air conditioning duct, which is laid in place before the concrete is poured for the joist. It is apparent, of course, that the geometry of section 56 or 59 is preferably chosen so that the duct or pipe work conforms closely to the joist-forming sections to avoid leaking of concrete during the pouring of the joists. In the pre-cast version of the method, as above described, the ducts preferably come up to the bottom edge of the side members 3 and 4 of the pre-cast slab soffit 1. In the poured-in-place version later to be described, the arrangement of FIG. 8 might be preferred, wherein the ductwork conforms to cutaway sections 56 and may project up into the finished concrete layer.

To pour the joists, the module of FIG. 8 is lowered into place by a hoist, as shown in FIG. 4. The legs 24 are set upon the next lower floor, or suspended from column super-structure, and adjusted in height to bring the interior girder form 23 and the spandrel form 53 into proper position for attachment to columns 22. Fastening means as above described, and suitable reinforcing materials are laid in the form work. If desired, the pre-cast slab soffits described above, or other connecting members, are placed across adjacent pairs of joist forms, as shown in FIG. 4, wherein the slab soffits are illustrated at 54. The joists, spandrel and girder are then poured. Alternatively, the joists, spandrel and girder may be poured without connecting members, thus producing a grid-like structure upon which a floor can then be constructed.

According to the system of the present invention, it is preferable to pour the joists with a high-strength concrete. This will permit setting to a strength sufficient to permit construction of the next higher floor the next day, in many instances. To accomplish this, the concrete should meet the following criteria:

1. It should have a high cement factor, i.e., from about five bags to about seven bags, per cubic yard, such that a strength of 3000 psi is reached after 24 hours; or it should be high in early strength admixtures, for example, Pozzolith (trademark of Master Builders) H.E. 100 in an amount of 16 oz. per cubic yard.

2. The concrete should have a maximum of a 3-inch slump.

3. The ambient temperature should be at least 70° F. If the weather is too cold to permit this ambient temperature, the outside of the forms could be sprayed with urethane foam, or the equivalent, so that they will hold the heat of exothermic reaction of the concrete, and therefore stay warm. At air temperatures below 40° F., it may be necessary to apply eletrical heating elements to the joist forms.

The joist concrete is poured, in one or two pours, up to the level of the top of soffit slabs 54. The concrete is consolidated by conventional vibrators, and smoothed. Since the slab soffits have been trowelled smooth at the time of pre-casting, the only concrete finishing required at the building construction site will be the small area at the top of the pour slot for each joist.

After the concrete is set the forms are stripped away by simply flexing the side forming members, either by means of a mechanical actuator (as described above with respect to FIG. 7), or by other means known in the art. The side form members being thus separated, the module is lowered by means of the adjustable support legs 24 (FIG. 4), or support cables. The forming module 19 can then be moved to the next location.

By employing the above-described system, an eight-man crew should be able to strip, fly and reset 20,000 square feet of forms in five hours. The forms can be removed in 24 hours at 3000 psi.

In a steel-framed building, it is possible to suspend the forming module from above, by cables attached to the steel structure, rather than supporting it from below, as described heretofore.

An alternative to the above-described system involves poured-in-place soffits, and is advantageous in eliminating a significant amount of previously required form work, and retains the weight-reduction advantages referred to above in connection with pre-cast soffits. This alternative might be preferred where a casting factory is not readily available.

The alternative system would form the soffits in place by placing the fire-resistant board across adjacent joist-forming members of the forming module, and then pouring the joists and the soffits, either in a single pour or in two separate pours. In either case, there is a significant additional advantage in eliminating the costly and time-consuming labor associated with previously known "pan joist" modular arrangements, wherein the entire form area needed to be cleaned after every section is poured; with the present invention, wet concrete touches only the joist, spandrel and interior girder areas.

It should be understood, throughout this application that where "concrete" is mentioned as a material for a component of the soffits, equivalent materials are intended to be included, such as structural fiberglass and plastics.

Similarly, the directional terms "up," "down" and the like, with respect to pre-cast soffits, are used for purposes of a frame of reference only. The pre-cast soffits could, for example, be made "upside down,"

first pouring the concrete and then working in the fire-resistant board.

The subject matter for which I seek Letters Patent is defined in the following claims.

I claim:

1. A method of making a section of a structural slab of a building floor, comprising the steps of:

a. implacing forming members for the casting of a pair of side sections of a slab soffit in spaced relationship to each other at a site removed from said building;

b. placing a sheet of fireproofing material between and upon said side-section forming members, said sheet extending partially over the top of each of said side-section forming members;

c. pouring concrete on said sheet and into said side-section forming member, to form a monolithic slab soffit;

d. removing said slab soffit from said side-section forming members;

e. placing a forming module in juxtaposition to a plurality of vertically extending columns of said building, said module containing at least a plurality of joist-forming members to be placed as a unit, at least some of said joist-forming members containing cut-away portions shaped to conform to ductwork members extending downwardly from the tops of sid joist-forming members;

f. laying ductwork members in the cut-away portions of said joist-forming members, so as to seal said portions against subsequent leakage of concrete from said joist-forming members when step (h) is performed;

g. placing said monolithic slab soffit between and upon an adjacent pair of said joist-forming members, the sides of said soffit extending partially into the respective joist-forming members; and h. pouring concrete into said joist-forming members, up to the tops of said soffits, to form a complete, monolithic structural slab section.

2. The method of claim 1, wherein said forming module is of an open-grid configuration having spaces between adjacent joist-forming members.

3. A method of constructing a structural slab of a building, comprising the steps of:

a. placing a forming module in juxtaposition to a plurality of vertically extending columns, said module containing at least a plurality of joist-forming members to be placed as a unit, at least some of said joist-forming members containing cut-away portions shaped to conform to ductwork members extending downwardly from the tops of said joist-forming members;

b. laying ductwork members in the cut-away portions of said joist-forming members, so as to seal said portions against subsequent leakage of concrete from said joist-forming members when step (d) is performed;

c. placing sheets of fire-resistant board between and upon adjacent pairs of joist-forming members; and d. pouring concrete into said joist-forming members and over said sheets, to form a complete, monolithic structural slab section.

4. The method of claim 3, wherein said forming module is of an open-grid configuration having spaces between adjacent joist-forming members.

5. A method of making a section of a structural slab of a building floor, comprising the steps of:

a. implacing forming members for the casting of a pair of side sections of a slab soffit in spaced relationship to each other at a site removed from said building;

b. placing a sheet of fireproofing material between and upon said side-section forming members, said sheet extending partially over the top of each of said side-section forming members;

c. pouring concrete on said sheet and into said side-section forming members, to form a monolithic slab soffit having downwardly projecting side portions spaced apart a given distance;

d. removing said slab soffit from said side-section forming members;

e. placing a forming module in juxtaposition to a plurality of vertically extending columns of said building, said module containing at least a plurality of joist-forming members to be placed as a unit, the space between a pair of adjacent joist-forming members being substantially equal to said given distance;

f. placing at least one monolithic slab soffit made according to steps (a)-(d) between and upon an adjacent pair of said joist-forming members, the sides of said soffit extending downward partially into the respective joist-forming members; and g. pouring concrete into said joist-forming members, up to the tops of said slab soffit, to form a complete, monolithic structural slab section.

6. The method of claim 5, wherein said forming module is of an open-grid configuration having spaces between adjacent joist-forming members.

* * * * *